US011393395B2

(12) United States Patent
Kim et al.

(10) Patent No.: US 11,393,395 B2
(45) Date of Patent: Jul. 19, 2022

(54) DISPLAY DEVICE AND METHOD FOR DRIVING THE SAME

(71) Applicant: LG DISPLAY CO., LTD., Seoul (KR)

(72) Inventors: Nakyoon Kim, Paju-si (KR); Hyungguk Bae, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/767,907

(22) PCT Filed: Sep. 4, 2018

(86) PCT No.: PCT/KR2018/010242
§ 371 (c)(1),
(2) Date: May 28, 2020

(87) PCT Pub. No.: WO2019/124676
PCT Pub. Date: Jun. 27, 2019

(65) Prior Publication Data

US 2020/0402455 A1 Dec. 24, 2020

(30) Foreign Application Priority Data

Dec. 22, 2017 (KR) ..... 10-2017-0178335

(51) Int. Cl.
*G09G 3/3233* (2016.01)

(52) U.S. Cl.
CPC ... *G09G 3/3233* (2013.01); *G09G 2320/0626* (2013.01); *G09G 2330/021* (2013.01); *G09G 2330/027* (2013.01)

(58) Field of Classification Search
CPC ..... G09G 3/3233; G09G 2330/027; G09G 2320/0626; G09G 2330/021
See application file for complete search history.

(56) References Cited

U.S. PATENT DOCUMENTS 8,154,482 B2 * 4/2012 Lee ..... G09G 5/393 345/77
2010/0033467 A1 * 2/2010 Park ..... H02M 3/155 345/211

(Continued)

FOREIGN PATENT DOCUMENTS

EP 0 443 083 A2 8/1991
KR 10-2010-0018254 A 2/2010
KR 10-2016-0014135 A 2/2016

*Primary Examiner* — Jeff Piziali
(74) *Attorney, Agent, or Firm* — Birch, Stewart, Kolasch & Birch, LLP

(57) ABSTRACT

In an embodiment of the present disclosure, there is provided a display device including: a plurality of subpixels between a line of a first power voltage and a line of a second power voltage, the plurality of subpixels configured to be supplied with a driving current and to emit light in response to the driving current; and a power supply unit configured to generate the first power voltage and the second power voltage based on an external input voltage, wherein the power supply unit generates power when the external input voltage corresponds to between a preset maximum voltage and a minimum voltage, and the power supply unit reduces a voltage difference between the first power voltage and the second power voltage when the external input voltage corresponds to between a preset reference voltage and the minimum voltage.

7 Claims, 5 Drawing Sheets

(56) References Cited

U.S. PATENT DOCUMENTS

| | | | | |
|---|---|---|---|---|
| 2011/0080338 | A1* | 4/2011 | Berkay | H02M 3/28 345/156 |
| 2011/0205202 | A1 | 8/2011 | Son et al. | |
| 2011/0242087 | A1* | 10/2011 | Ebisuno | G09G 3/3233 345/212 |
| 2011/0273427 | A1* | 11/2011 | Park | G09G 3/3225 345/212 |
| 2012/0044273 | A1 | 2/2012 | Park et al. | |
| 2015/0244267 | A1* | 8/2015 | Park | G09G 3/3233 345/76 |
| 2016/0027381 | A1 | 1/2016 | Ryu et al. | |
| 2016/0041606 | A1 | 2/2016 | Andrews et al. | |

* cited by examiner

[Fig. 1]
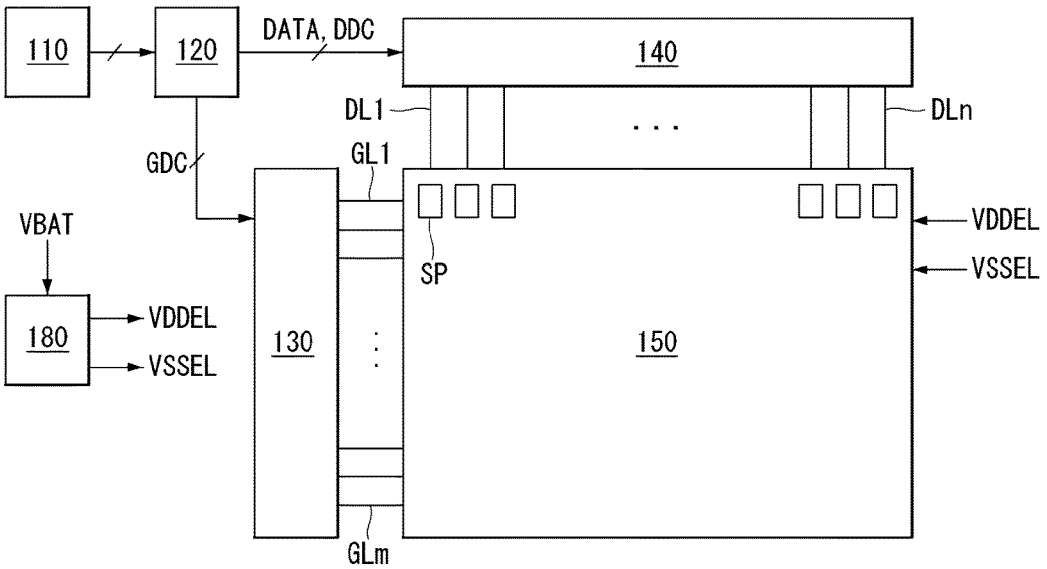
[Fig. 2]
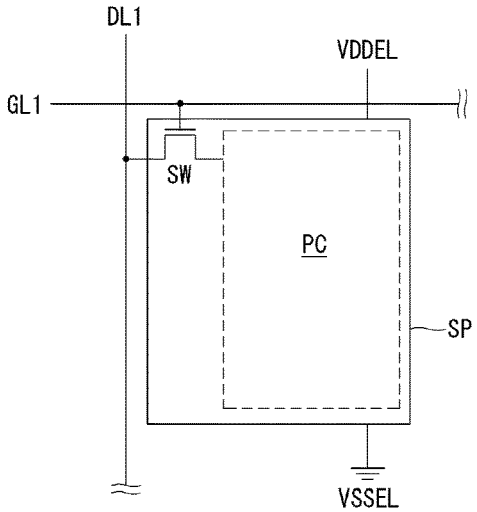
[Fig. 3]
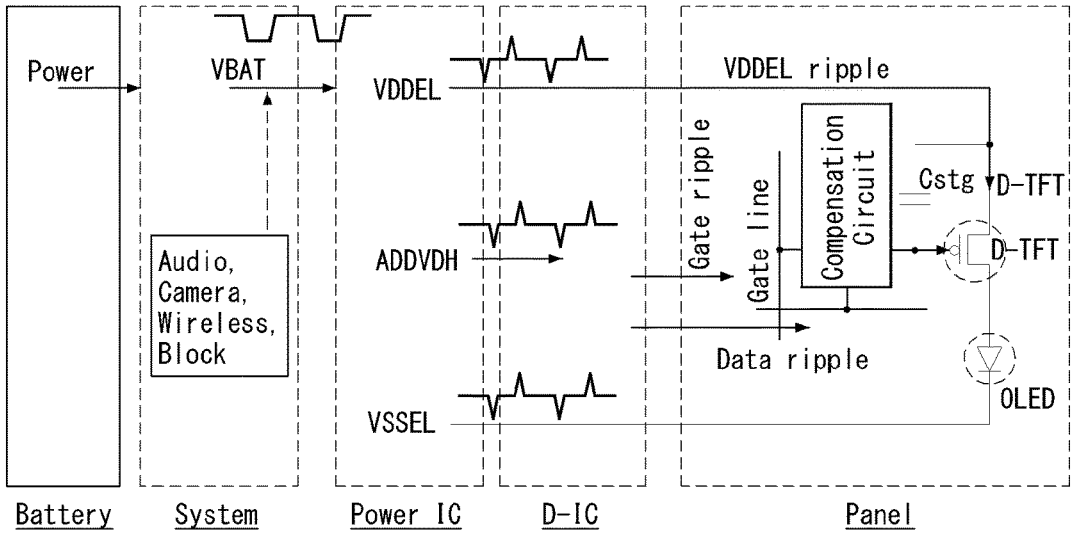

[Fig. 4]
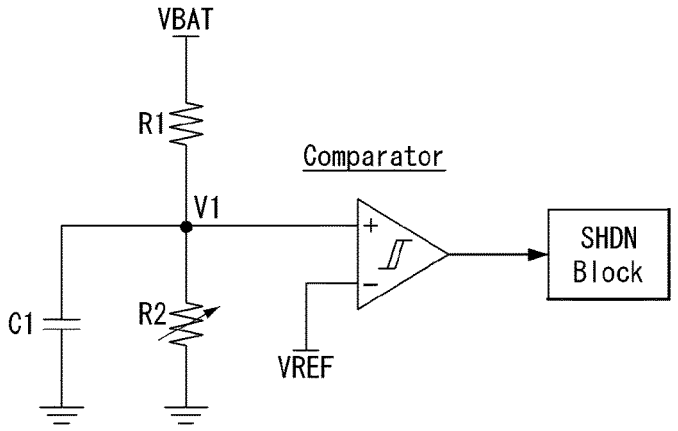
[Fig. 5]
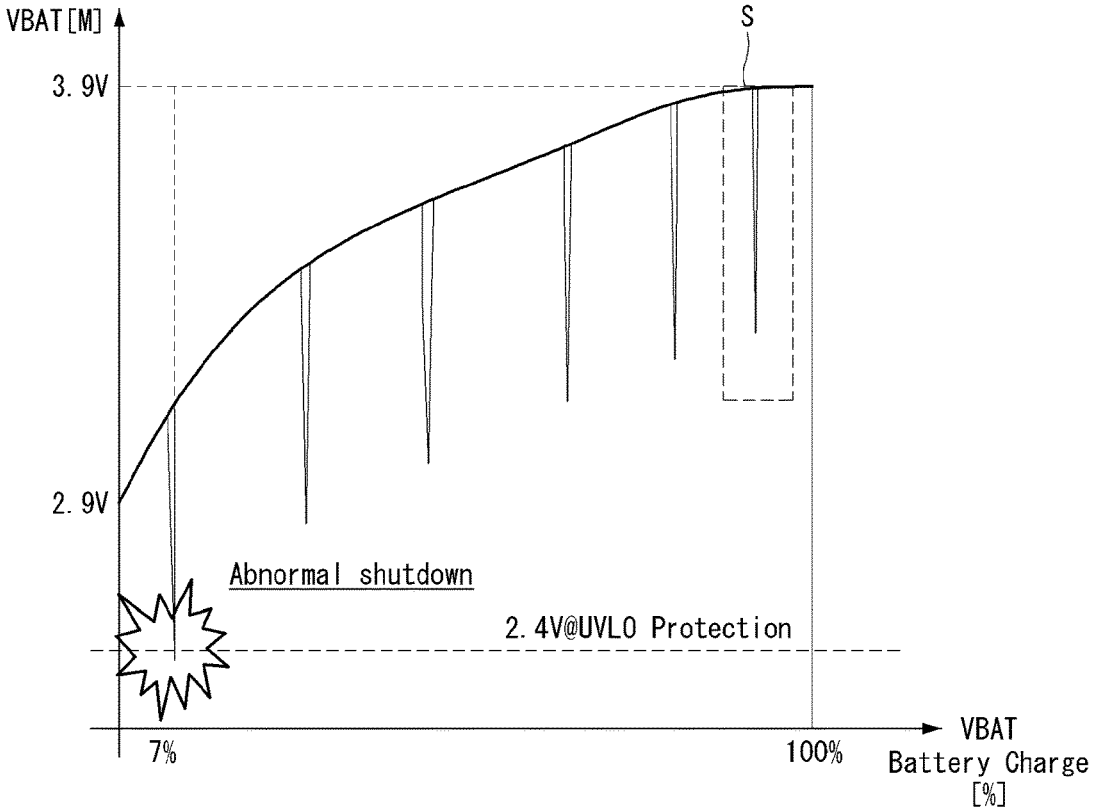
[Fig. 6]
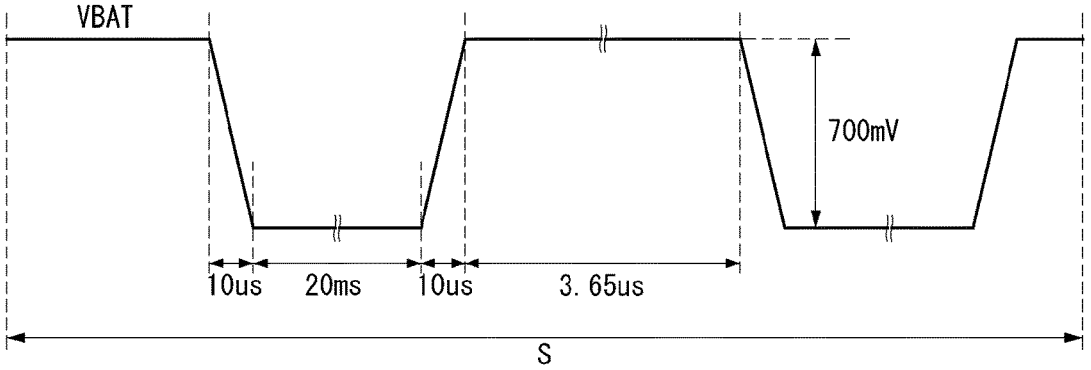

[Fig. 7]
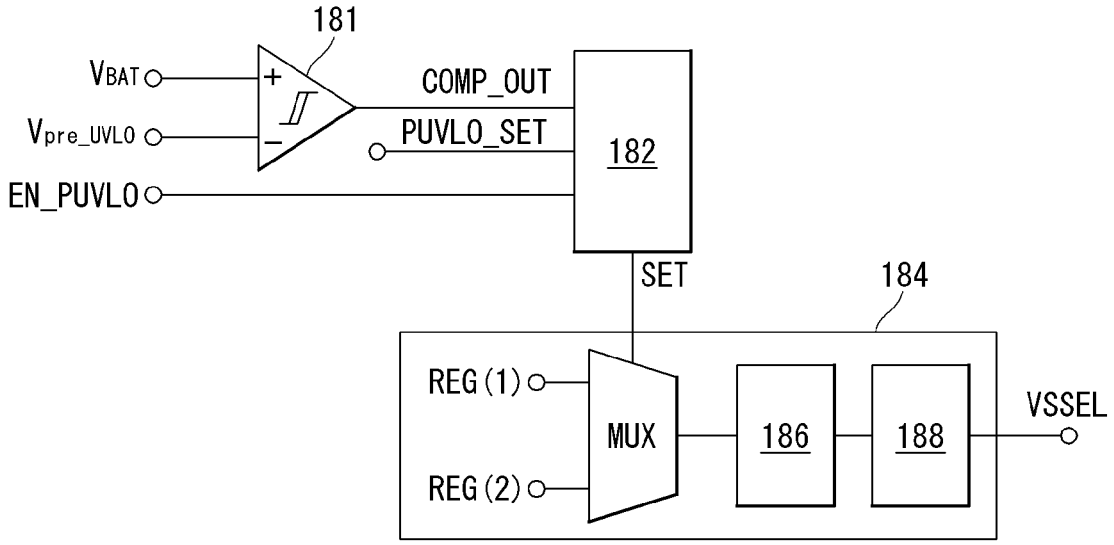
[Fig. 8]
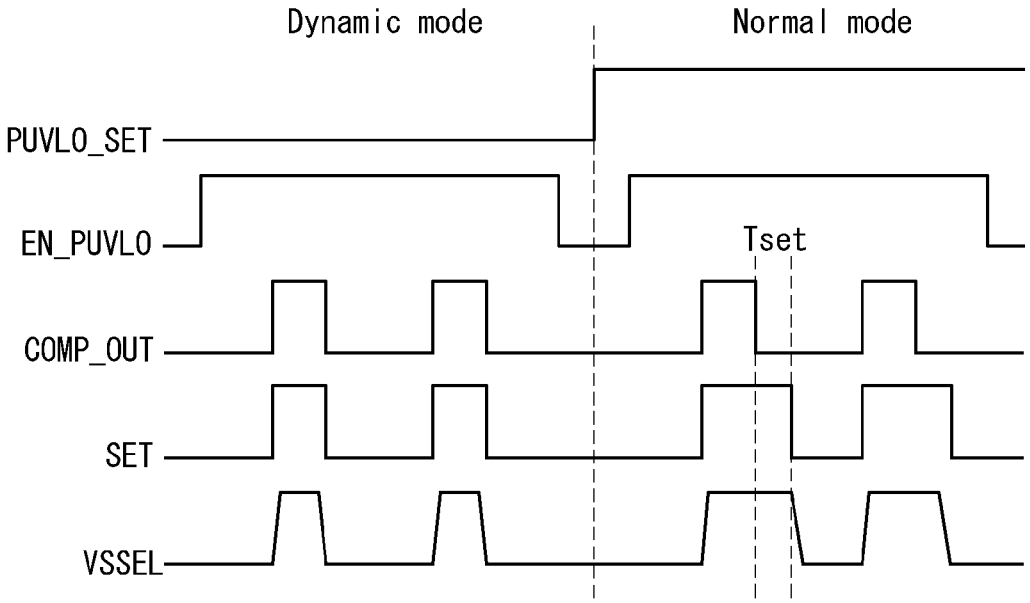

[Fig. 9]
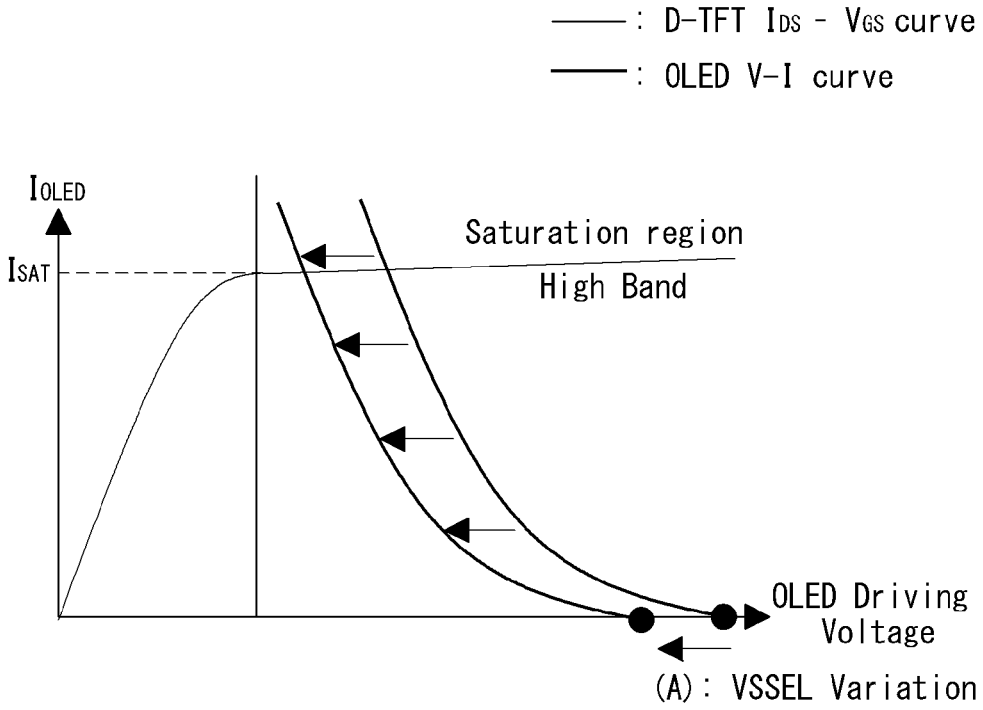
[Fig. 10]
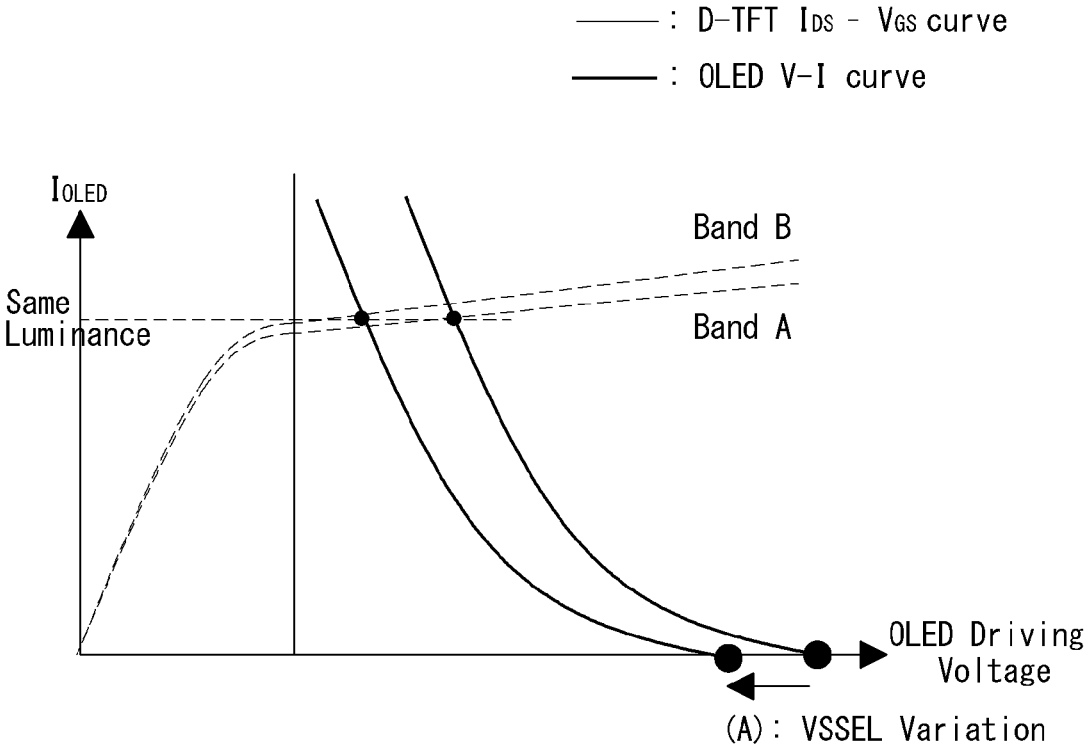

[Fig. 11]
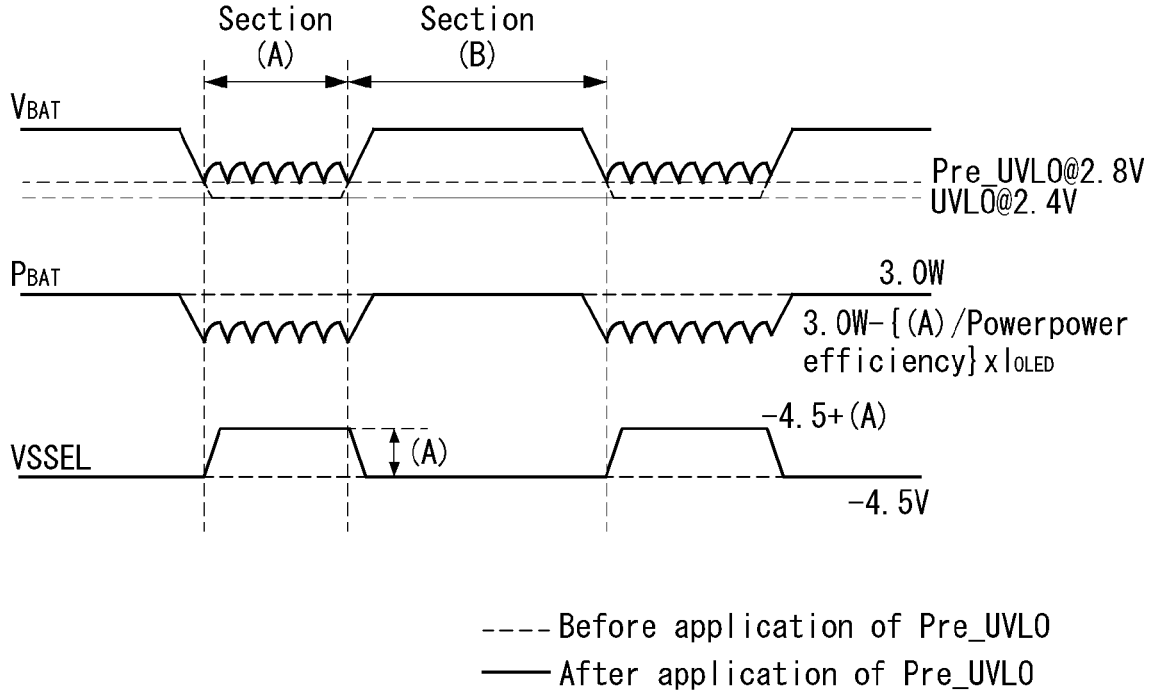

DISPLAY DEVICE AND METHOD FOR DRIVING THE SAME

CROSS REFERENCE TO RELATED APPLICATIONS

This application is the National Phase of PCT International Application No. PCT/KR2018/010242, filed on Sep. 4, 2018, which claims priority under 35 U.S.C. 119(a) to Patent Application No. 10-2017-0178335, filed in the Republic of Korea on Dec. 22, 2017, all of these applications are hereby expressly incorporated by reference into the present application.

TECHNICAL FIELD

The present disclosure relates to a display device and a method for driving the same.

BACKGROUND ART

As portable devices, such as smart phones, Personal Digital Assistances (PDAs), laptops, and cameras, are widely used and these electronic devices have become embedded with multi-functions and highly integrated, more sophisticated operations are required. In addition, more powers are required for the use of these devices and even for the standby mode thereof, and thus, power management of mobile electronic devices has emerged as an important issue when it comes to energy saving and battery life.

A mobile electronic device includes a variety of system components, for example, Radio Frequency (RF) and/or audio applications such as a wireless transmitter, a receiver, a microphone and a display device. Among the system configurations, the display device is considered more important as a means for connecting a user to information since information technologies are advancing. Accordingly, there are increasing demands for Flat Panel Display device (FPD), such as Liquid Crystal Display device (LCD), organic light-emitting display device, Plasma Display device Panel (PDP), and the like.

Some of the display devices, for example, an LCD and the organic light-emitting display device, may display device an image in a manner in which a selected subpixel emit light or allow light to pass therethrough when a gate signal, a data signal, or the like is supplied to a plurality of subpixels arranged in a matrix form.

A display device includes a Power Management IC (PMIC) that controls power required for driving the display device. The PMIC is supplied with power from a battery, and generate and output power at a voltage required for driving the display device. The PMIC has adapted a Under Voltage Lock Out (UVLO) scheme in order to minimize malfunction caused by abrupt change of an input voltage. Accordingly, the PMIC perform a shutdown function to cease supplying power when a system input voltage exceeds a range between a preset minimum voltage and a preset maximum voltage.

DISCLOSURE OF INVENTION

Technical Problem

However, when a remaining battery power is low, battery power VBAT input to the PMIC is inevitably vulnerable to noise. For example, even in the case where an actual voltage of the battery is at a low level that does not trigger a shutdown, an input voltage of the PMIC may instantly drop due to system noise occurring in an audio or a camera, and accordingly, abnormal shutdown may occur despite the sufficient battery power.

Solution to Problem

To solve the aforementioned problem of the related art, present disclosure provides a display device, which prevents abnormal shutdown that occurs when an input voltage input to the PMIC instantly drops despite sufficient battery power, and a method for driving the display device panel.

Advantageous Effects of Invention

According to at least one of embodiments of the present invention, disclosure sets a Pre-UVLO voltage higher than an existing UVLO reference voltage. If the battery power VBAT is determined to reach the Pre-UVLO voltage, the present disclosure reduces power to be supplied to the display device panel 150. That is, if the battery power voltage VBAT is lower than a reference voltage Vpre-UVLO, a second voltage VSSEL at a level higher than a normal level is output to reduce power to be supplied to a display device panel. If the power supply unit reduces an output voltage, a power load applied to the battery power VBAT is reduced and therefore it is more likely to avoid a phenomenon in which the battery voltage VBAT becomes unstable due to noise in the system unit.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 1 is block diagram schematically illustrating a display device.

FIG. 2 is a diagram schematically illustrating a subpixel shown in FIG. 1.

FIG. 3 is a block diagram illustrating power flow in a display device.

FIG. 4 is diagram showing a Under Voltage Lock Out (UVLO) circuit of a power supply unit according to a comparable example.

FIG. 5 is a waveform diagram illustrating a problem caused by shutdown occurring in a power supply unit according to the comparable example.

FIG. 6 is an enlarged waveform diagram showing a shutdown point in FIG. 5.

FIG. 7 is a circuit diagram of a power supply unit according to an embodiment of the present disclosure.

FIG. 8 is a waveform diagram of input and output signals in the power supply unit circuit shown in FIG. 7.

FIGS. 9 and 10 are graphs for explaining a method for controlling power of a power supply unit according to an embodiment of the present disclosure.

FIG. 11 is a waveform diagram of input and output power of a power supply unit according to an embodiment of the present disclosure.

MODE FOR THE INVENTION

Reference will now be made in detail embodiments of the disclosure examples of which are illustrated in the accompanying drawings.

Advantages and features of the present disclosure and a method of achieving the same will be clearly understood from embodiments described below in detail with reference to the accompanying drawings. However, the present disclosure is not limited to the following embodiments and may be implemented in various different forms. The embodiments are provided merely for complete disclosure of the present disclosure and to fully convey the scope of the disclosure to those of ordinary skill in the art to which the present disclosure pertains. The present disclosure is defined only by the scope of the claims.

The figures, dimensions, ratios, angles, numbers of elements given in the drawings are merely illustrative and are not limiting. Further, in describing the present disclosure, descriptions on well-known technologies may be omitted in order not to obscure the gist of the present disclosure. It is to be noticed that the terms "comprising," "having," "including" and so on, used in the description and claims, should not be interpreted as being restricted to the means listed thereafter unless specifically stated otherwise. Where an indefinite or definite article is used when referring to a singular noun, e.g. "a," "an," "the," this includes a plural of that noun unless specifically stated otherwise.

In describing positional relationship, such as "an element A on an element B," "an element A above an element B," "an element A below an element Bi" and "an element A next to an element B," another element C may be disposed between the elements A and B unless the term "directly" or "immediately" is explicitly used.

The terms first, second, third and the like in the descriptions and in the claims are used for distinguishing between similar elements and not necessarily for describing a sequential or chronological order. These terms are used to merely distinguish one element from another. Accordingly, as used herein, a first element may be a second element within the technical idea of the present disclosure.

Features of various exemplary embodiments of the present disclosure may be combined partially or totally. As will be clearly appreciated by those skilled in the art, technically various interactions and operations are possible. Various exemplary embodiments can be practiced individually or in combination.

Hereinafter, various exemplary embodiments of the present disclosure will be described in detail with reference to the accompanying drawings. Like reference numerals denote like elements throughout the descriptions. In describing the present disclosure, descriptions on well-known technologies may be omitted in order not to obscure the gist of the present disclosure.

A display device according to an embodiment of the present disclosure may be selected from among Liquid Crystal Display device (LCD), organic light-emitting display device, Plasma Display device Panel (PDP), and the like, but the present disclosure is not limited thereto. In the following description, the display device is exemplified by an organic light-emitting display device for convenience of explanation.

FIG. 1 is a block diagram schematically illustrating an organic light-emitting display device, and FIG. 2 is a diagram schematically illustrating a subpixel shown in FIG. 1.

As shown in FIG. 1, the organic light-emitting display device includes an image supply 110, a timing controller 120, a scan driver 130, a data driver 140, and a power supply unit 180.

A display device panel 150 displays devices an image in response to a scan signal and a data signal DATA output from a driver including the scan driver 130 and the data driver 140. The display device panel 150 is implemented as a top emission type, a bottom emission type, or a dual emission type.

The display device panel 150 is implemented to have a flat structure, a curved structure, or a flexible structure, depending on a substrate material. The display device panel 150 is implemented in a manner such that subpixels SP provided between two substrates emit light by themselves in response to a driving current.

As shown in FIG. 2, one subpixel includes a switching transistor SW connected to (or formed at an intersection with) a scanline GL1 and a data line DL1, and a pixel circuit PC which operates in response to a data signal DATA supplied via the switching transistor SW. the pixel circuit PC includes a driving transistor, a storage capacitor, and an organic light emitting diode.

When the driving transistor is turned on in response to a data voltage stored in the storage capacitor, a driving current is supplied to the organic light emitting diode that is provided between a first power line and a second power line VSSEL. The organic light emitting diode emits light in response to the driving current.

The image supply 110 performs image processing with respect to a data signal, and outputs the data signal together with a vertical synchronization signal, a horizontal synchronization signal, a data enable signal, a clock signal, and the like. The image supply 110 provides the vertical synchronization signal, the horizontal synchronization signal, the data enable signal, the clock signal, the data signal, and the like to the controller 120.

The timing controller 120 is supplied with a data signal from the image supply 110, and outputs a gate timing control signal GDC for controlling an operation timing of the scan driver 130 and a data timing control signal DDC for controlling an operation timing of the data driver 140. The timing controller 120 supplies a data signal DATA together with the data timing control signal DDC to the data driver 140.

In response to the gate timing control signal GDC supplied from the timing controller 120, the scan driver 130 outputs a scan signal while shifting a level of a gate voltage. The scan driver 130 includes a level shifter and a shift resistor. The scan driver 130 supplies the scan signal via the scan lines GL1 to GLm to subpixels SP included in the display device panel 150.

The scan driver 130 may be formed in a Gate In Panel (GIP) structure or in a Integrated Circuit (IC) form in the display device panel 150. A portion of the scan driver 130 formed in the GIP structure is the shift register.

In response to the timing control signal DDC supplied from the timing controller 120, the data driver 140 may sample and latch the data signal DATA, and convert a digital signal into an analog signal in response to a gamma reference voltage and output the digital signal.

The data driver 140 may supplies the data signal DATA via data lines DL1 to DLn to subpixels SP included in the display device panel 150. The data driver 140 may be formed in an IC form.

The power supply unit 180 generates and outputs power based on input power supplied from the outside. The input power supplied from the outside may include battery power VBAT. The power supply unit 180 generates and outputs a first power voltage VDDEL and a second power voltage VSSEL by varying the input battery power VBAT. The power supply unit 180 may be composed of a DCDC converter that converts a first DC voltage, which is an input voltage, into a second DC voltage which is different from the first DC voltage.

The first power voltage VDDEL and the second power voltage VSSEL output from the power supply unit 180 are supplied to the display device panel 150. The first power voltage VDDEL corresponds to a high potential voltage, and the second power voltage VSSEL corresponds to a low potential voltage. The power supply unit 180 may generate power to be supplied to a controller or a driver included in the display device.

The display device configured as above display devices a specific image as the display device panel 150 emits light or allow light to pass therethrough based on power VDDEL and VSSEL output from the power supply unit 180, and a scan signal and a data signal DATA output from the scan driver 130 and the data driver 140.

The power VDDEL and VSSEL output from the power supply unit 180 needs not just to have good efficiency, but also to maintain stability and reliability of outputting. For this reason, Under Voltage Lock Out (UVLO) by which outputting of a voltage stops when an input voltage exceeds a range between a preset minimum voltage and a maximum voltage has been adapted.

Hereinafter, a comparable example of a conventionally proposed method and an embodiment o the present disclosure will be described.

FIG. 3 is a block diagram illustrating power flow in a display device.

Referring to FIG. 3, charged power in the battery 160 is supplied to a system unit 170, such as an audio block, a camera block, and a wireless block. The power supply unit 180 of the display device generates a first power voltage VDDEL and a second power voltage VSSEL by varying an input power VBAT input to the battery 160. The first power voltage VDDEL and the second power voltage VSSEL generated in the power supply unit 180 are supplied via the data driver 140 to the display device panel 150.

A subpixel in the display device panel 150 operates in a manner in which, when a driving transistor D-TFT is turned on in response to a data voltage stored in a storage capacitor Cstg, a driving current is supplied to an organic light emitting diode (OLED) provided between a supply line of the first power voltage VDDEL and a supply line of the second power voltage VSSEL. The OLED emits light in response to the driving current.

Meanwhile, power of the battery 160 is supplied even to a system unit 170, such as an audio block, a camera block, and a wireless block, in addition to the display device panel 150. Due to the use of power by the system unit 170, ripples may occur in a waveform a of an input power VBAT that is input to the power supply unit 180.

Due to the change in the input power VBAT(a) input to the power supply unit 180, a first power voltage VDDEL(b) and a second power voltage VSSEL(d) output from the power supply unit 180 is changed.

As the first power voltage input to the display device panel 150 is changed (1), a gate driving voltage and data of the driving transistor D-TFT is changed (2) and this may cause change in the gate power (4) and change in the data power (3). As a result, a driving current IOLED (IOLED=β (VVDDEL Vdata)2) of the OLED is changed, and therefore, noise occurs on the display device panel 150 (5).

To solve this problem, UVLO by which outputting of a voltage stops when an input voltage exceeds a range between a preset minimum voltage and a maximum voltage has been adapted conventionally.

FIG. 4 is diagram showing a Under Voltage Lock Out (UVLO) circuit of a power supply unit according to a comparable example.

When input power VBAT input to the power supply unit drops to a voltage less than a preset UVLO voltage, the UVLO circuit shown in FIG. 4 outputs a shutdown signal to stop operation of the power supply unit.

The UVLO circuit includes a comparator that compares a voltage V1, which divides a voltage of the input power VBAT into resistance R1 and R2, and a reference voltage VREF. A voltage of the UVLO circuit performing shutdown operation may be set by adjusting a value of the resistance R2.

If V1>VREF, the comparator outputs a low signal. If V1<VREF, the comparator outputs a high signal. An output from the comparator is input to a shutdown (SHDN) block that outputs a shutdown signal. The SHDN block operates in response to the high signal, and does not operate in response to the low signal.

If the voltage V1 dividing the input power VBAT into R1 and R2 is smaller than the reference voltage VREF, the comparator outputs a high signal. Having received the high signal of the comparator, the SHDN block stops operation of the power supply unit.

The comparator compares the reference voltage VREF and the voltage V1, which divides a voltage of the input power VBAT into resistance R1 and R2. Since the UVLO circuit shown in FIG. 4 satisfies V1=VBAT*R2/(R1+R2), it is possible to adjust a voltage of the UVLO circuit, which triggers a shutdown operation, by adjusting R2. For example, if VBAT=2.4V or smaller, R1=10 kΩ, R2=10 kΩ, and VREF=1.2V may be set to perform the shutdown operation.

When the input power VBAT input to the power supply unit drops to be smaller than a preset UVLO voltage, the UVLO circuit outputs a shutdown signal to stop operation of the power supply unit. However, abnormal shutdown occurs in this UVLO circuit.

FIG. 5 is a waveform diagram showing a problem caused by shutdown occurring in a power supply unit according to the comparable example, and FIG. 6 is an enlarged waveform diagram showing a shutdown point in FIG. 5.

Referring to FIG. 5, a battery voltage in a system using a battery is slowly discharged from 3.9V to 2.9. During discharging of the battery, ripple may occur which means that the battery power VBAT drops instantly due to noise occurring in the system unit 170, such as an audio block, a camera block, and a wireless block. Referring to a graph of FIG. 6 which shows an enlarged view of a voltage ripple section S, voltage drop of about 0.7 V may occur in the battery power VBAT due to noise occurring in the system unit 170.

Even though the voltage drop of 0.7V occurs when the battery power VBAT is sufficient, a voltage higher than a UVLO reference voltage of 2.4V may be maintained. However, if the battery power VBAT is discharged to about 7%, the battery power VBAT may be maintained to be about 3.1V.

In the case where a voltage drop of about 0.7V occurs due to noise in the system unit when the battery power VBAT is about 3.1V, the battery power VBAT may drop all the way to the UVLO reference voltage of 2.4V, thereby leading to a shutdown. That is, even though 7% of battery power is left, an abnormal shutdown may take place due to noise in the system unit 170.

To solve this problem, the power supply unit in this specification sets a Pre-UVLO voltage higher than an existing UVLO reference voltage. If the battery power VBAT is determined to reach the Pre-UVLO voltage, the power supply unit reduces power to be supplied to the display device panel 150. If the power supply unit reduces output power, a power load applied to the battery power VBAT is reduced and therefore it is more likely to avoid a phenomenon in which the battery power VBAT becomes unstable due to noise in the system unit 170.

FIG. 7 is a circuit diagram of a power supply unit according to an embodiment of the present disclosure.

Referring to FIG. 7, the power supply unit includes an external voltage detection unit 181 configured to compare a reference voltage Vpre-UVLO and a battery power VBAT input from the outside and output a comparison result; a control signal generator 185 configured to output a power setting signal according to the comparison result; and a power voltage generator 184 configured to receive the power setting signal and output a normal-power voltage or a low-power voltage.

The external voltage detection unit 181 compares the reference voltage Vpre-UVLO and the battery power VBAT input from the outside, and outputs a comparison result. The battery power VBAT is external power that is input to the power supply unit. The reference voltage Vpre-UVLO is a voltage that is set to prevent occurrence of a shutdown due to instability of the battery power VBAT, and the reference voltage Vpre-UVLO may be set to be higher than the a UVLO voltage which is a system shutdown voltage. The external voltage detection unit 181 may include a comparator to compare the reference voltage Vpre-UVO and the battery power VBAT and output a comparison result signal COMP_OUT. The comparison result signal CONP_OUT may be output in the form of a low signal or a high signal. For example, the external voltage detection unit 181 may output a low signal in response to the reference voltage Vpre-UVLO being higher than the battery power voltage VBAT, and a high signal in response to the reference voltage Vpre-UVLO being lower than the battery power voltage VBAT.

The control signal generator 185 outputs an output power setting signal SET to the power voltage generator 184 according to the comparison result signal COMP_OUT and power settings EN_PIUVLO and PUVLO_SET. Among power setting inputs of the control signal generator 185, EN_PIVLO is a signal for enabling a Pre_UVLO function. PUVLO_SET is a signal for selecting an operation mode for the Pre_UVLO function, and PUVLO_SET may allow selecting Normal mode and Dynamic mode. The power setting inputs of the control signal generator 185, that is, whether to enable the Pre_UVLO function and setting the Normal mode/Dynamic mode may be set by a user's selection, may be set in a system design stage, or may be set when a specific condition is satisfied.

The control signal generator 185 may receive an EN)PUVLO signal to enable the Pre_UVLO function. The control signal generator 185, of which the Pre-UVLO function is enabled, outputs a power setting signal SET to the power voltage generator 185 according to the comparison result signal COMP_OUT. When the battery power voltage VBAT is higher than the reference voltage Vpre-UVLO, the control signal generator 185 may output the power setting signal SET so that a second power voltage VSSEL with the normal level is output. When the battery power voltage VBAT is lower than the reference voltage Vpre-UVLO, the control signal generator 185 may output the power setting signal SET so that the second power voltage VSSEL with a level higher than the normal level is output.

In addition, when outputting the power setting signal SET, the control signal generator 185 may select the normal mode and the dynamic mode. The dynamic mode is a mode in which the second power voltage VSSEL ripples in real time according to the comparison result signal COMP_OUT, and the normal mode is a node in which, once the second power voltage VSSEL is changed, this voltage is maintained for a preset period of time.

The power voltage generator 184 outputs a normal power voltage or a low power voltage according to the power setting signal SET. According to the power setting signal SET, the power voltage generator 184 may generate a normal power voltage to output the second power voltage VSSEL with a normal level, or may generate a low power voltage to output the second power voltage VSSEL with the normal level.

The power voltage generator 184 includes: a multiplexer MUX configured to output a voltage setting value, which is selected from resistors REG(1) and REG(2) storing voltage values, in accordance with the power setting signal SET; a PWM controller 186 configured to generate power in accordance with an output from the multiplexer MUX; and a converter 188.

In the resistors REG(1) and REG(2) storing voltage values, a set value REG(1) corresponding to a second power voltage VSSEL at the normal level and a set value REG(2) corresponding to a second power voltage VSSEL at a level higher than the normal level generated in a Pre_UVLO operation may be stored.

The power setting signal SET of the power voltage generator 184 is input by output selection of the multiplexer MUS. The multiplexer MUS outputs a set value of a selected register in accordance with the power setting signal SET.

The PWM controller 186 and the converter 188 generate a second power voltage VSSEL from the battery power VBAT in accordance with a set value stored in the resistors REG(1) and REG(2).

Due to this configuration, in accordance with the power setting signal SET, the power voltage generator 184 may generate normal power voltage, which is the second power voltage VSSEL with the normal level, or a low power voltage, which is the second power voltage VSSEL with a level higher than the normal level.

FIG. 8 is a waveform diagram of input and output signals in the power supply unit circuit shown in FIG. 7, and shows the cases where the Pre_UVLO function is executed in the normal mode and where the Pre UVLO function is executed in the dynamic mode.

Referring to FIGS. 7 and 8, if EN_PUVLO with a high level is input to the control signal generator 1851 the Pre_UVLO function is enabled.

PUVLO_SET may be used to select the normal mode or the dynamic mode. If PUVLO_SET is input at a low level, the dynamic mode is on. If PUVLO_SET is input at a high level, the normal mode is on.

The external voltage detection unit 181 may compare the reference voltage Vpre-UVLO and the battery power VBAT, and output a comparison result signal COMP_OUT. The external voltage detection unit 181 may output a low signal when the reference voltage Vpre-UVLO is higher than the battery power voltage VBAT, or may output a high signal when the reference voltage Vpre-UVLO is lower than the battery power voltage VBAT.

If a high signal is output in a state in which the reference voltage Vpre-UVLO is lower than the battery power VBAT, the Pre_UVLO circuit may operate to step up VSSEL voltage so as to compensate for the battery power VBAT.

In this case, in the dynamic mode, the second power voltage VSSEL is changed in real time in accordance with the comparison result signal COMP_OUT. In the normal mode, the second power voltage VSSE is changed in accordance with the comparison result signal COMP_OUT, the changed voltage is maintained for a preset period of time Tset.

In the dynamic mode, if the comparison result signal COM_OUT is changed fast, the second power voltage VSSEL is changed fast as well. Due to the fast change, flicker may occur. On the other hand, in the normal mode, the second power voltage VSSEL is maintained for the preset period of time Tset, and thus, a relatively stable operation is possible.

FIGS. 9 and 10 shows a graph about a relationship between a power control method according to an embodiment of the present disclosure and luminance of a display device panel.

A subpixel of the display device includes an OLED and a driving transistor D-TFT. If the driving transistor D-TFT is turned on in response to a data voltage stored in a storage capacitor Cstg, a driving current is supplied to the OLED provided between a supply line of the first power voltage VDDEL and a supply line of the second power voltage VSSEL. Accordingly, the OLED emits light in response to the driving current.

In this specification, during the Pre-UVLO operation, the second power voltage VSSEL is stepped up to reduce a voltage difference between the second power voltage VSSEL and the first power voltage VDDEL and thus maintain the battery voltage stably.

Referring to FIG. 9, the driving current of the OLED is changed as much as a variation A in the second power voltage VSSEL. However, this operation is performed in a saturation region, luminance is changed very little. Thus, even in the case where the second power voltage VSSEL is adjusted to reduce power consumption, quality of display deviceing an image may be maintained.

FIG. 10 shows an example of controlling luminance and the second power voltage VSSEL. Band B and Band A indicate luminance of an OLED display device panel.

In an image having luminance Band A, if a driving voltage of an OLED is reduced as much as a variation A of the second power voltage VSSEL, the luminance of the image may be reduced a little bit.

In this case, in order to maintain the previous luminance, the luminance of the image may be adjusted to luminance Band B which is brighter than luminance Band A. Between Band B and Band A, there is no change in a gray scale and only overall luminance is adjusted.

Thus, by controlling luminance and the second power voltage VSSEL simultaneously, it is possible to maintain an image quality to be the same as a previous quality, and to reduce power consumption as much as a variation A in the second power voltage VSSEL.

FIG. 11 is a waveform view of input and output power of a power supply unit according to an embodiment of the present disclosure.

When VSSEL=−4.5V, VSSEL_PUVLO=−2.0V, Pre_UVLO=2.8V, efficiency=90%, and IOLED=0.3 A are assumed, power consumption in sections (A) and (B) may be calculated as below.

Power consumption in Section (*A*): PBAT=(0.3A×4.5V/0.9)−(0.3A×(−4.5)/0.9)=1.5 W+1.5 W=3.0 W Power consumption in Section (*B*): PBAT=(0.3A×4.5V/0.9)−(0.3A×(−2.0)/0.9)=1.5 W+0.66 W=2.16 W As above, since the power consumption PBAT is reduced, a power load applied to the battery voltage is reduced. Accordingly, the battery power VBAT becomes stable and thus it is possible to prevent occurrence of an abnormal shutdown.

As described above, the present disclosure sets a Pre-UVLO voltage higher than an existing UVLO reference voltage. If the battery power VBAT is determined to reach the Pre-UVLO voltage, the present disclosure reduces power to be supplied to the display device panel 150. That is, if the battery power voltage VBAT is lower than a reference voltage Vpre-UVLO, a second voltage VSSEL at a level higher than a normal level is output to reduce power to be supplied to a display device panel. If the power supply unit reduces an output voltage, a power load applied to the battery power VBAT is reduced and therefore it is more likely to avoid a phenomenon in which the battery voltage VBAT becomes unstable due to noise in the system unit.

Thus, exemplary embodiments of the present disclosure have been described in detail with reference to the accompanying drawings. However, the present disclosure is not limited to the exemplary embodiments, and modifications and variations can be made thereto without departing from the technical idea of the present disclosure. Accordingly, the exemplary embodiments described herein are merely illustrative and are not intended to limit the scope of the present disclosure. The technical idea of the present disclosure is not limited by the exemplary embodiments. The scope of protection sought by the present disclosure is defined by the appended claims and all equivalents thereof are construed to be within the true scope of the present disclosure.

The invention claimed is:

1. A display device comprising:

a plurality of subpixels between a line of a first power voltage and a line of a second power voltage, the plurality of subpixels configured to be supplied with a driving current and to emit light in response to the driving current; and a power supply unit configured to generate the first power voltage and the second power voltage based on an external input voltage, wherein the power supply unit comprises:

an external voltage detection unit configured to output a first level of a comparison result signal when the external input voltage is higher than a reference voltage, and output a second level of the comparison result signal when the external input voltage is between the reference voltage and a minimum voltage, and a control signal generator configured to receive the comparison result signal operation mode, and control the generation of the second power voltage based on the comparison result signal and the operation mode, wherein the power supply unit generates a normal-power voltage power as the second power voltage in response to the first level of the comparison result signal, and generates a love-power voltage as the second power voltage in response to the second level of the comparison result signal to reduce a voltage difference between the first power voltage and the second power voltage, wherein when the external input voltage is lower than the minimum voltage, the power supply unit performs a shutdown function to stop generating power, wherein the reference voltage is higher than the minimum voltage, wherein in a first mode, the control signal generator controls, when the comparison result signal is changed between the first level and the second level, the second power voltage to be changed in real time between the normal power supply voltage and the low power supply voltage corresponding to the comparison result signal, and wherein in the second mode, the control signal generator determines, when the comparison result signal is changed between the first level and the second level, whether a preset time has elapsed since the second power was last changed, controls, when the preset time has elapsed, the second power voltage to be changed between the normal power supply voltage and the low power supply voltage corresponding to the comparison result signal, and controls, when the preset time has not elapsed, to be maintained at a previously controlled voltage.

2. The display device of claim 1, wherein the external input voltage comprises battery power.

3. The display device of claim 1, wherein the control signal generator is further configured to output a power setting signal for generating the second power voltage in accordance with the comparison result signal; and wherein the power supply unit includes a power voltage generator configured to receive the power setting signal, and generate and output the second power voltage of a first voltage level or a second voltage level higher than the first level.

4. The display device of claim 3, wherein the external voltage detection unit comprises a comparator configured to output the first or second signal depending on the result of comparison between the reference voltage and the external input voltage.

5. The display device of claim 3, wherein, when the reference voltage is lower than the external input voltage, the control signal generator outputs the power setting signal for generating the second power voltage of the first voltage level.

6. The display device of claim 3, wherein, when the reference voltage is higher than the external input voltage, the control signal generator outputs the power setting signal for generating the second power voltage of the second voltage level.

7. A method for controlling supply power of a display device by a power supply unit, the method comprising:

checking whether an external input voltage corresponds to between a maximum voltage and a minimum voltage;

checking whether the external input voltage corresponds to between a reference voltage and the minimum voltage;

outputting a first level of a comparison result signal when the external input voltage is higher than a reference voltage or a second level of the comparison result signal when the external input voltage is between the reference voltage and the minimum voltage;

controlling a voltage difference between a first power voltage and a second power voltage based on the comparison result signal and an operation mode; and performing a shutdown function to stop generating power when the external input voltage is lower than the minimum voltage, wherein the reference voltage is higher than the minimum voltage, and wherein the controlling of the voltage difference between the first power voltage and the second power voltage comprises:

in a first mode, when the comparison result signal is changed between the first level and the second level, controlling the second power voltage to be changed in real time between a normal power supply voltage and a low power supply voltage corresponding to the comparison result signal; and in a second mode, determining, when the comparison result signal is changed between the first level and the second level, whether a preset time has elapsed since the second power was last changed, controlling, when the preset time has elapsed, the second power voltage to be changed between the normal power supply voltage and the low power supply voltage corresponding to the comparison result signal, and controlling, when the preset time has not elapsed, the second power voltage to be maintained at a previously controlled voltage.

* * * * *